US009147967B2

(12) United States Patent
Johnson et al.

(10) Patent No.: US 9,147,967 B2
(45) Date of Patent: Sep. 29, 2015

(54) ELECTRICAL CONNECTORS AND METHODS FOR USING SAME

(71) Applicant: Tyco Electronics Canada ULC, Markham (CA)

(72) Inventors: Barry James Johnson, Vaughan (CA); Alexandru P. Bulza, Aurora (CA)

(73) Assignee: Tyco Electronics Canada ULC, Markham (CA)

( * ) Notice: Subject to any disclaimer, the term of this patent is extended or adjusted under 35 U.S.C. 154(b) by 56 days.

(21) Appl. No.: 14/015,313

(22) Filed: Aug. 30, 2013

(65) Prior Publication Data

US 2014/0073203 A1 Mar. 13, 2014

Related U.S. Application Data

(60) Provisional application No. 61/699,689, filed on Sep. 11, 2012, provisional application No. 61/833,133, filed on Jun. 10, 2013.

(51) Int. Cl.
*H01R 13/62* (2006.01)
*H01R 13/621* (2006.01)
(Continued)

(52) U.S. Cl.
CPC ..... *H01R 13/621* (2013.01); *H01R 4/36* (2013.01); *H01R 31/02* (2013.01); *H01R 43/26* (2013.01); *Y10T 29/49208* (2015.01)

(58) Field of Classification Search
CPC ..... H01R 13/621; H01R 31/02; H01R 4/36
USPC ..... 439/810–814
See application file for complete search history.

(56) References Cited

U.S. PATENT DOCUMENTS 1,679,677 A * 8/1928 Milne ..... 439/100
2,116,776 A * 5/1938 Bondeson ..... 439/804
(Continued)

FOREIGN PATENT DOCUMENTS

EP 1 914 837 A2 4/2008
GB 2 257 850 A 1/1993
(Continued)

OTHER PUBLICATIONS

The Okonite Company, Product Data Section 2: Sheet 21, C-L-X Type MV-90 or MC-HL 2.4 kV Okoguard Nonshielded Power Cable-Aluminum Sheath, Admitted Prior Art, Retrieved from the internet at URL http://okonite.com/Product_Catalog/section2/section2-pdfs/2-21.pdf.
(Continued)

*Primary Examiner* — Ross Gushi
(74) *Attorney, Agent, or Firm* — Myers Bigel Sibley & Sajovec, PA

(57) ABSTRACT

An electrical connection assembly includes a plurality of primary electrical conductors, a secondary electrical conductor, and an electrical connector. The electrical connector includes: a first connector body including an exterior conductor seat channel; a second connector body coupled to the first connector body such that the first and second connector bodies collectively form an axial through passage; a primary clamping mechanism on at least one of the first and second connector bodies; and a secondary clamping mechanism on the first connector body. The secondary connector extends through the exterior conductor seat channel and is clamped therein by the secondary clamping mechanism. The primary conductors extend through the axial through passage and are clamped therein by the primary clamping mechanism to the first and second connector bodies and to one another to mechanically and electrically connect the primary and secondary conductors.

21 Claims, 19 Drawing Sheets

(51) Int. Cl.

| | |
|---|---|
| ***H01R 43/26*** | (2006.01) |
| ***H01R 4/36*** | (2006.01) |
| ***H01R 31/02*** | (2006.01) |

(56) References Cited

U.S. PATENT DOCUMENTS

| | | | | |
|---|---|---|---|---|
| 2,551,636 | A * | 5/1951 | Ratigan | 279/112 |
| 2,907,978 | A * | 10/1959 | Bergan | 439/811 |
| 3,058,087 | A * | 10/1962 | Piasecki | 439/100 |
| 3,339,174 | A * | 8/1967 | Walter et al. | 439/793 |
| 3,544,955 | A * | 12/1970 | Ruiz | 439/792 |
| 3,638,172 | A * | 1/1972 | Adam | 439/791 |
| 3,688,246 | A * | 8/1972 | Toedtman et al. | 439/412 |
| 3,742,431 | A * | 6/1973 | Kobryner | 439/814 |
| 3,876,279 | A * | 4/1975 | Underwood | 439/797 |
| 3,901,577 | A * | 8/1975 | Philibert et al. | 439/804 |
| 3,988,052 | A * | 10/1976 | Mooney et al. | 439/804 |
| 4,103,986 | A * | 8/1978 | Izraeli | 439/811 |
| 4,131,257 | A * | 12/1978 | Sterling | 248/67.5 |
| 4,159,859 | A * | 7/1979 | Shemtov | 439/100 |
| 4,189,198 | A * | 2/1980 | Reichman | 439/100 |
| 4,248,490 | A * | 2/1981 | Bachle | 439/98 |
| 4,427,258 | A * | 1/1984 | Mueller | 439/814 |
| 4,640,571 | A * | 2/1987 | Walter et al. | 439/791 |
| 4,776,808 | A * | 10/1988 | Davidson | 439/100 |
| 4,780,096 | A * | 10/1988 | Franks, Jr. | 439/813 |
| 4,909,592 | A * | 3/1990 | Arroyo et al. | 385/113 |
| 5,004,437 | A * | 4/1991 | Walter et al. | 439/811 |
| 5,021,014 | A * | 6/1991 | Walter et al. | 439/798 |
| D334,914 | S * | 4/1993 | Walter et al. | D13/151 |
| 5,201,914 | A | 4/1993 | Hollick | |
| 5,494,462 | A * | 2/1996 | Auclair | 439/810 |
| 5,547,404 | A * | 8/1996 | Nellis et al. | 439/803 |
| 6,011,218 | A * | 1/2000 | Burek et al. | 174/40 CC |
| 6,042,430 | A | 3/2000 | Hollick | |
| 6,976,857 | B1 * | 12/2005 | Shukla et al. | 439/100 |
| 7,182,653 | B1 * | 2/2007 | Hoxha | 439/783 |
| 7,387,546 | B2 * | 6/2008 | Copper et al. | 439/781 |
| 7,494,385 | B2 * | 2/2009 | Copper et al. | 439/770 |
| 7,537,467 | B1 * | 5/2009 | Gretz | 439/108 |
| 7,621,763 | B2 * | 11/2009 | Clark et al. | 439/100 |
| 7,677,933 | B2 * | 3/2010 | Copper et al. | 439/781 |
| 7,862,390 | B2 * | 1/2011 | Copper | 439/781 |
| 7,997,943 | B2 * | 8/2011 | Gregory et al. | 439/782 |
| 8,231,392 | B2 * | 7/2012 | Garvin | 439/100 |
| 8,272,883 | B1 * | 9/2012 | Smith | 439/95 |
| 8,272,904 | B2 * | 9/2012 | Copper | 439/781 |
| 8,317,526 | B2 * | 11/2012 | Gardner et al. | 439/100 |
| 8,419,449 | B1 * | 4/2013 | Smith | 439/92 |
| 8,469,721 | B2 * | 6/2013 | Mitchell et al. | 439/66 |
| 8,512,052 | B2 * | 8/2013 | Garvin | 439/100 |
| 8,512,070 | B2 * | 8/2013 | De France | 439/479 |
| 8,759,695 | B2 * | 6/2014 | Pope | 200/51.14 |
| 8,864,504 | B1 * | 10/2014 | Gretz | 439/100 |
| 8,882,517 | B2 * | 11/2014 | Smith et al. | 439/92 |
| 2002/0142674 | A1 * | 10/2002 | Chadbourne et al. | 439/783 |
| 2004/0092142 | A1 * | 5/2004 | Clark et al. | 439/100 |
| 2005/0085111 | A1 * | 4/2005 | Clark et al. | 439/100 |
| 2005/0202732 | A1 * | 9/2005 | Rizzo et al. | 439/810 |
| 2008/0108234 | A1 * | 5/2008 | Clark et al. | 439/108 |
| 2008/0283686 | A1 * | 11/2008 | Copper | 248/74.1 |
| 2010/0011571 | A1 * | 1/2010 | Copper et al. | 29/758 |
| 2010/0015862 | A1 * | 1/2010 | Gregrory et al. | 439/783 |
| 2014/0000110 | A1 * | 1/2014 | Stauch et al. | 29/869 |
| 2014/0073203 | A1 * | 3/2014 | Johnson et al. | 439/810 |

FOREIGN PATENT DOCUMENTS

| | | | |
|---|---|---|---|
| GB | 2 272 803 | A | 5/1994 |
| GB | 2 299 901 | A | 10/1996 |
| GB | 2 319 401 | A | 5/1998 |
| GB | 2 319 402 | A | 5/1998 |
| GB | 2 330 105 | A | 4/1999 |
| WO | WO 00/46878 | A1 | 8/2000 |
| WO | WO 00/54371 | A1 | 9/2000 |
| WO | WO 01/35495 | A1 | 5/2001 |
| WO | WO 02/18803 | A1 | 3/2002 |
| WO | WO 02/29932 | A1 | 4/2002 |
| WO | WO 02/053325 | A1 | 7/2002 |

OTHER PUBLICATIONS

The Okonite Company, Ramsey, N.J. USA, North Coast Electric/U-Link Okonite Inquiry Portland 62-20414 (R12), Item #1, May 24, 2012, 1 page.

Tyco, Copper ShearBolt Connector Catalog Page, Copper ShearBolt Splice Connectors, 2012 Tyco Electronics Corporation, a TE Connectivity Ltd. company, Admitted Prior Art, Retrieved from the Internet at URL http://www.te.com/us/en/industries/energy/PDF/C_CSBC.pdf.

* cited by examiner

ELECTRICAL CONNECTORS AND METHODS FOR USING SAME

RELATED APPLICATIONS

The present application claims the benefit of and priority from U.S. Provisional Patent Application Ser. No. 61/699,689, filed Sep. 11, 2012, and from U.S. Provisional Patent Application Ser. No. 61/833,133, filed Jun. 10, 2013, the disclosures of which are hereby incorporated herein in their entireties.

FIELD OF THE INVENTION

The present invention relates to electrical connectors and, more particularly, electrical connectors for mechanically and electrically coupling power transmission conductors.

BACKGROUND

Electrical connectors are commonly used to mechanically and electrically connect electrical conductors such as power transmission conductors in an electrical network.

SUMMARY OF THE INVENTION

According to embodiments of the present invention, an electrical connection assembly includes a plurality of primary electrical conductors, a secondary electrical conductor, and an electrical connector. The electrical connector includes: a first connector body including an exterior conductor seat channel; a second connector body coupled to the first connector body such that the first and second connector bodies collectively form an axial through passage; a primary clamping mechanism on at least one of the first and second connector bodies; and a secondary clamping mechanism on the first connector body. The secondary connector extends through the exterior conductor seat channel and is clamped therein by the secondary clamping mechanism. The primary conductors extend through the axial through passage and are clamped therein by the primary clamping mechanism to the first and second connector bodies and to one another to mechanically and electrically connect the primary and secondary conductors.

According to further embodiments of the present invention, an electrical connector for electrically and mechanically coupling a plurality of primary electrical conductors and a secondary electrical conductor includes: a first connector body including an exterior conductor seat channel; a second connector body coupled to the first connector body such that the first and second connector bodies collectively form an axial through passage; a primary clamping mechanism on at least one of the first and second connector bodies; and a secondary clamping mechanism on the first connector body. The electrical connector is configured to mount the primary and secondary conductors therein such that: the secondary connector extends through the exterior conductor seat channel and is clamped therein by the secondary clamping mechanism; and the primary conductors extend through the axial through passage and are clamped therein by the primary clamping mechanism to the first and second connector bodies and to one another to mechanically and electrically connect the primary and secondary conductors.

According to method embodiments of the present invention, a method for electrically and mechanically coupling a plurality of primary electrical conductors and a secondary electrical conductor includes providing an electrical connector including: a first connector body including an exterior conductor seat channel; a second connector body coupled to the first connector body such that the first and second connector bodies collectively form an axial through passage; a primary clamping mechanism on at least one of the first and second connector bodies; and a secondary clamping mechanism on the first connector body. The method further includes mounting the electrical connector on the primary and secondary conductors such that: the secondary connector extends through the exterior conductor seat channel and is clamped therein by the secondary clamping mechanism; and the primary conductors extend through the axial through passage and are clamped therein by the primary clamping mechanism to the first and second connector bodies and to one another to mechanically and electrically connect the primary and secondary conductors.

According to embodiments of the present invention, an electrical connection assembly includes a plurality of primary electrical conductors, a secondary electrical conductor, and an electrical connector. The electrical connector includes a first connector body and a second connector body coupled to one another and collectively forming a through passage, and a clamping mechanism. The primary and secondary conductors extend through the through passage and are clamped therein to the connector and one another to mechanically and electrically connect the primary and secondary conductors.

According to embodiments of the present invention, an electrical connector for electrically and mechanically coupling a plurality of primary electrical conductors and a secondary electrical conductor includes a first connector body and a second connector body coupled to one another and collectively forming a through passage, and a clamping mechanism. The electrical connector is configured to mount the primary and secondary conductors therein such that the primary and secondary conductors extend through the through passage and are clamped therein to the connector and one another to mechanically and electrically connect the primary and secondary conductors.

According to method embodiments of the present invention, a method for electrically and mechanically coupling a plurality of primary electrical conductors and a secondary electrical conductor includes providing an electrical connector including: a first connector body and a second connector body coupled to one another and collectively forming a through passage; and a clamping mechanism. The method further includes mounting the electrical connector on the primary and secondary conductors therein such that the primary and secondary conductors extend through the through passage and are clamped therein to the connector and one another to mechanically and electrically connect the primary and secondary conductors.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
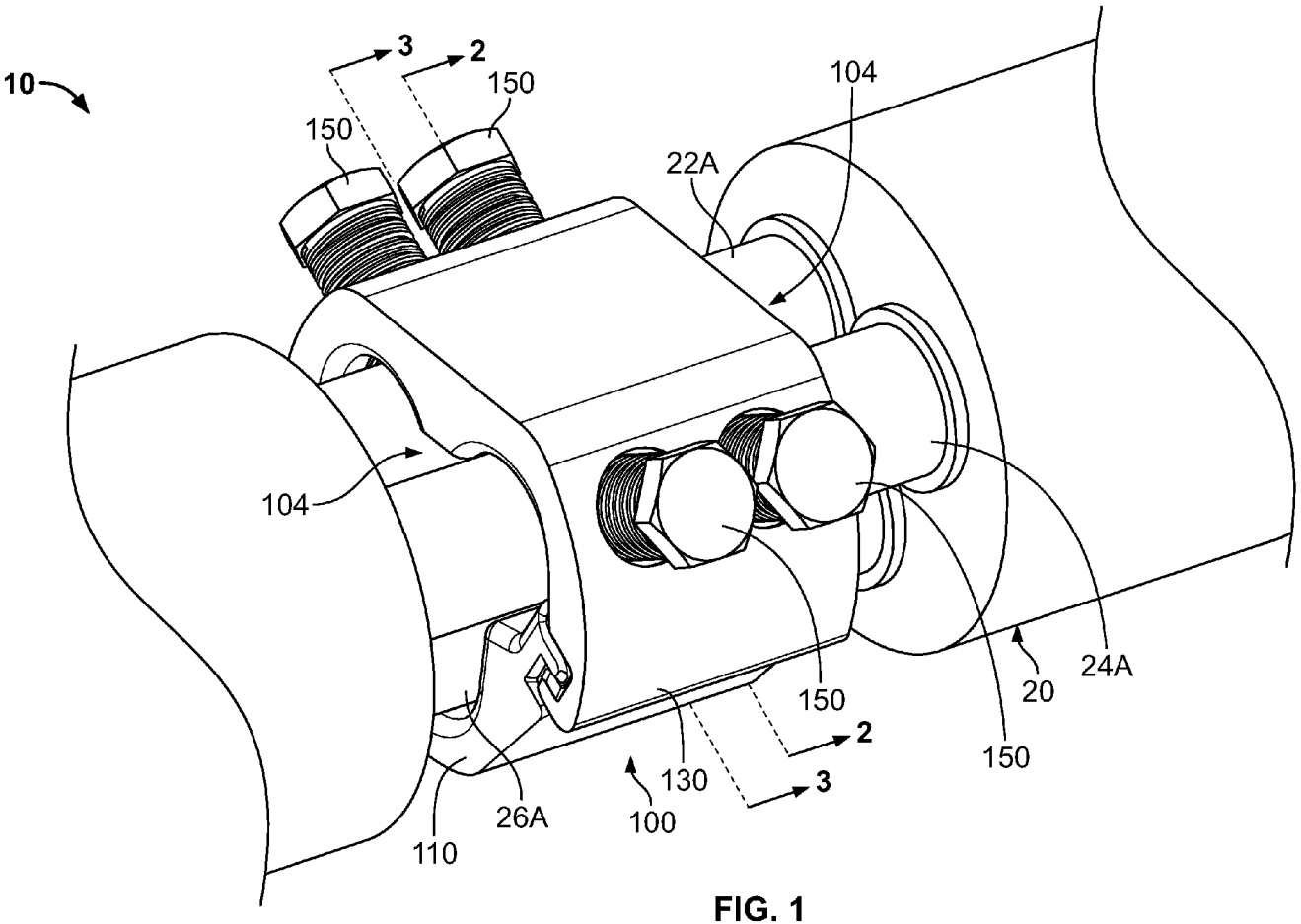
FIG. 1 is a fragmentary, perspective view of an electrical connection assembly according to embodiments of the present invention.
Figure 2:
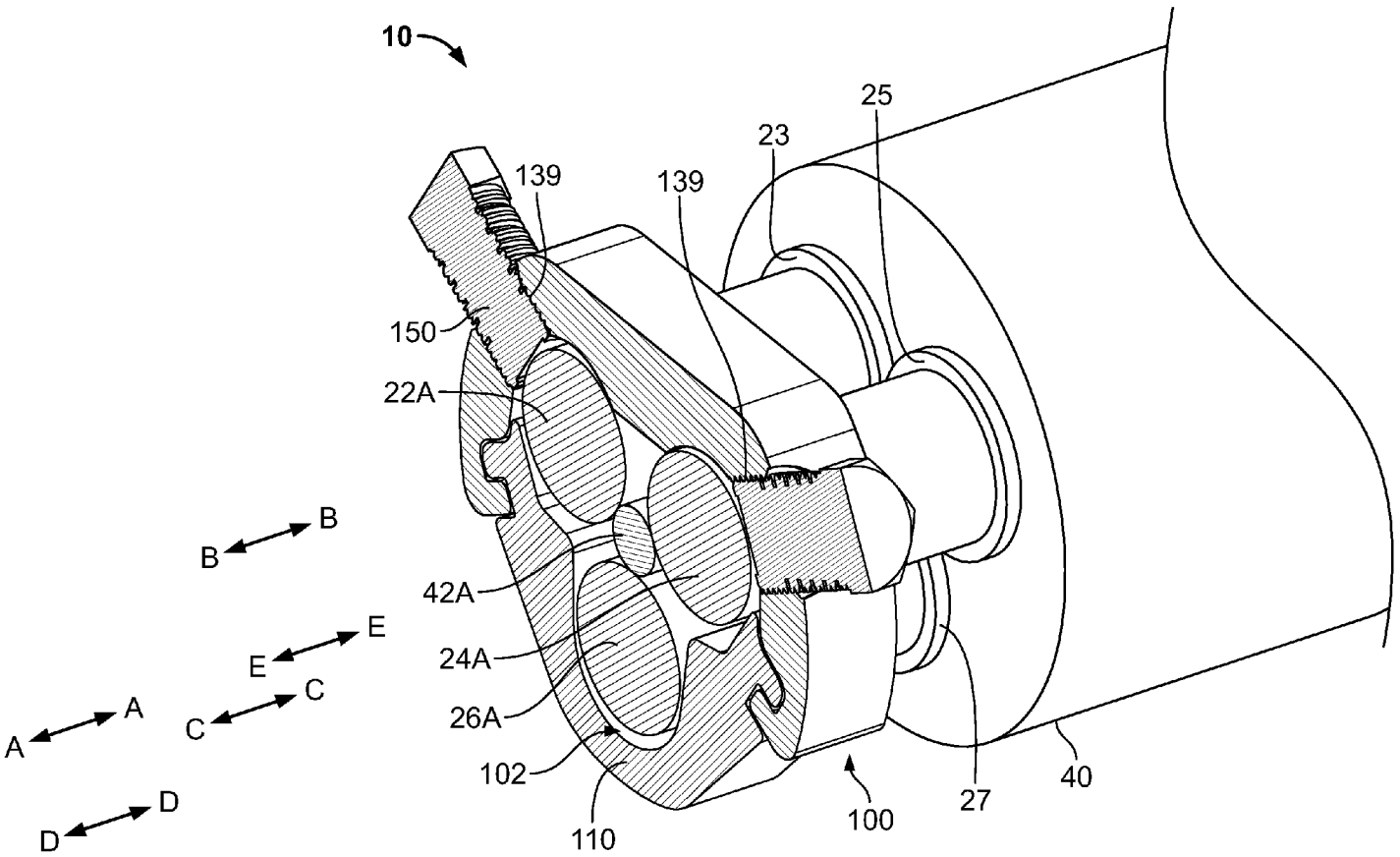
FIG. 2 is a fragmentary, cross-sectional, perspective view of the electrical connection assembly of FIG. 1 taken along the line 2-2 of FIG. 1.
Figure 3:
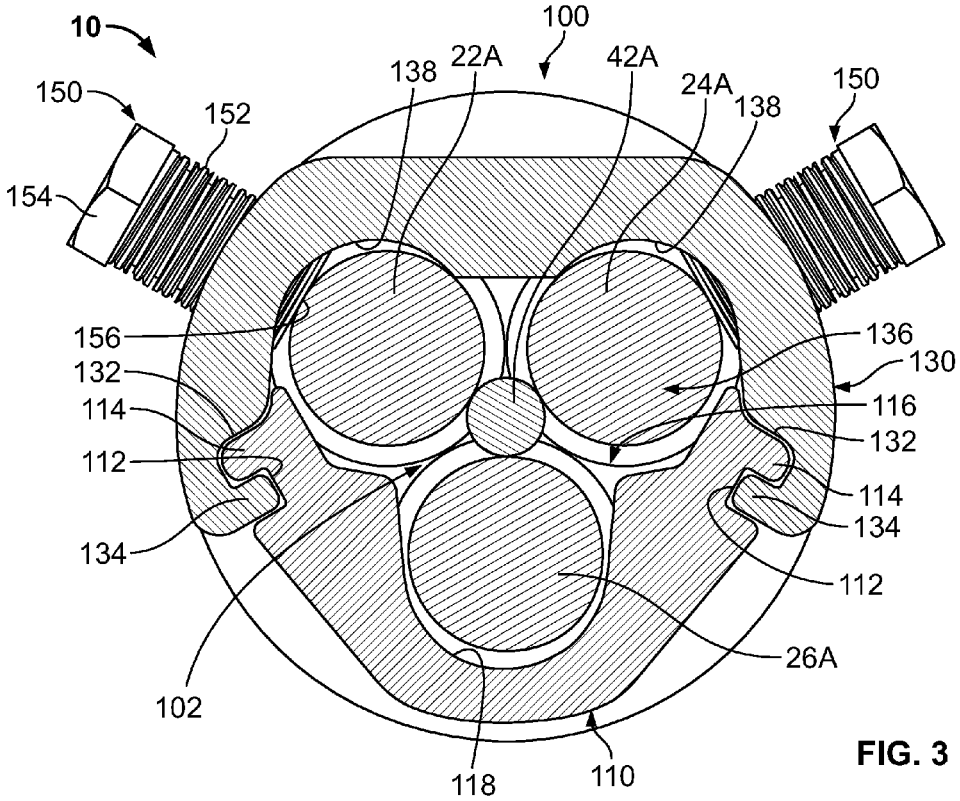
FIG. 3 is a cross-sectional, view of the electrical connection assembly of FIG. 1 taken along the line 3-3 of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-8, an electrical connection assembly 10 including an electrical connector 100 (FIG. 5) according to embodiments of the invention is shown therein. The connection assembly 10 includes sections of a primary, main or run cable 20 and a section of a secondary or tap cable 40, which are electrically and mechanically joined by the connector 100.

Figure 6:
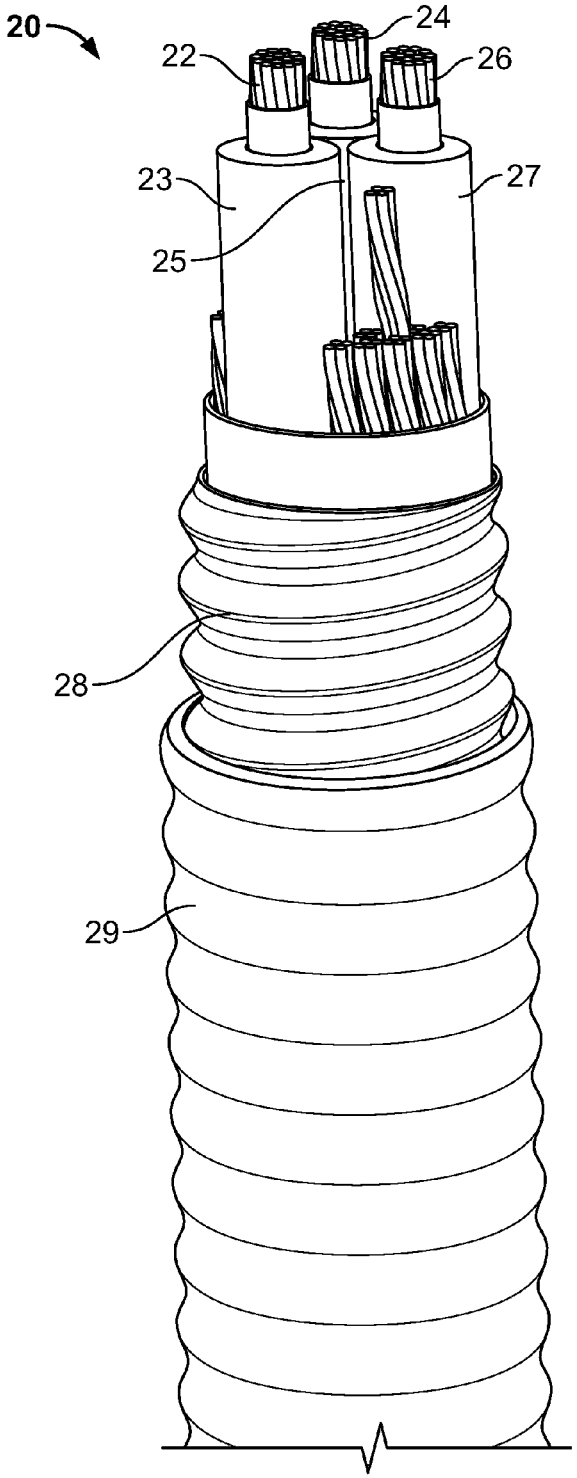
FIG. 6 is a perspective view of a run cable for use in the electrical connection assembly of FIG. 1.

An exemplary run cable 20 is shown in FIG. 6 and is also illustrated in part in FIGS. 1-4. The run cable 20 includes three electrically conductive (e.g., copper) run conductors 22, 24 and 26 having lengthwise axes B-B, C-C and D-D, respectively, and surrounded by electrical insulation layers 23, 25 and 27, respectively. The insulated conductors 22, 24, 26 may in turn be surrounded by a sheath or armor 28 (e.g., a corrugated aluminum sheath) and a polymeric jacket 29. The cable 20 may include other components such as semiconductive layers, grounding conductors, etc. (e.g., as shown in FIG. 6).

Figure 8:
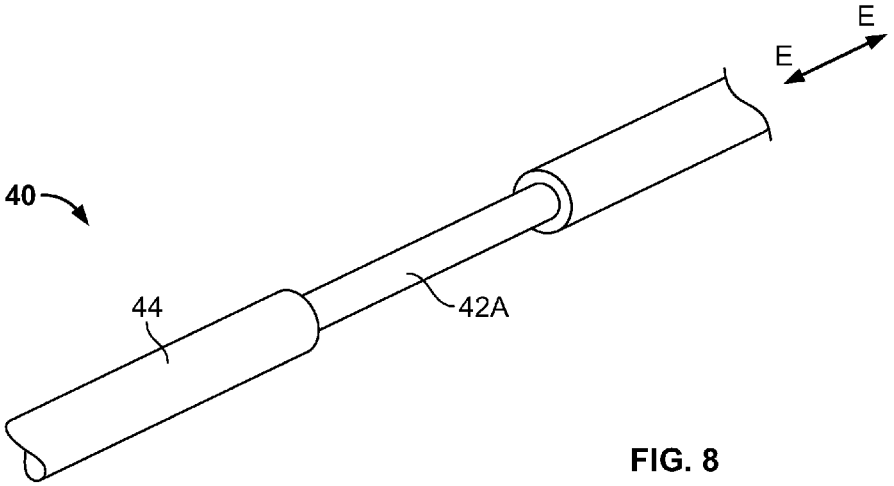
FIG. 8 is a fragmentary, perspective view of a tap cable prepared for installation to form the electrical connection assembly of FIG. 1.

An exemplary tap cable 40 is shown in FIG. 8 and includes an electrically conductive (e.g., copper) tap conductor 42 surrounded by a layer of electrically conductive insulation 44.

Figure 7:
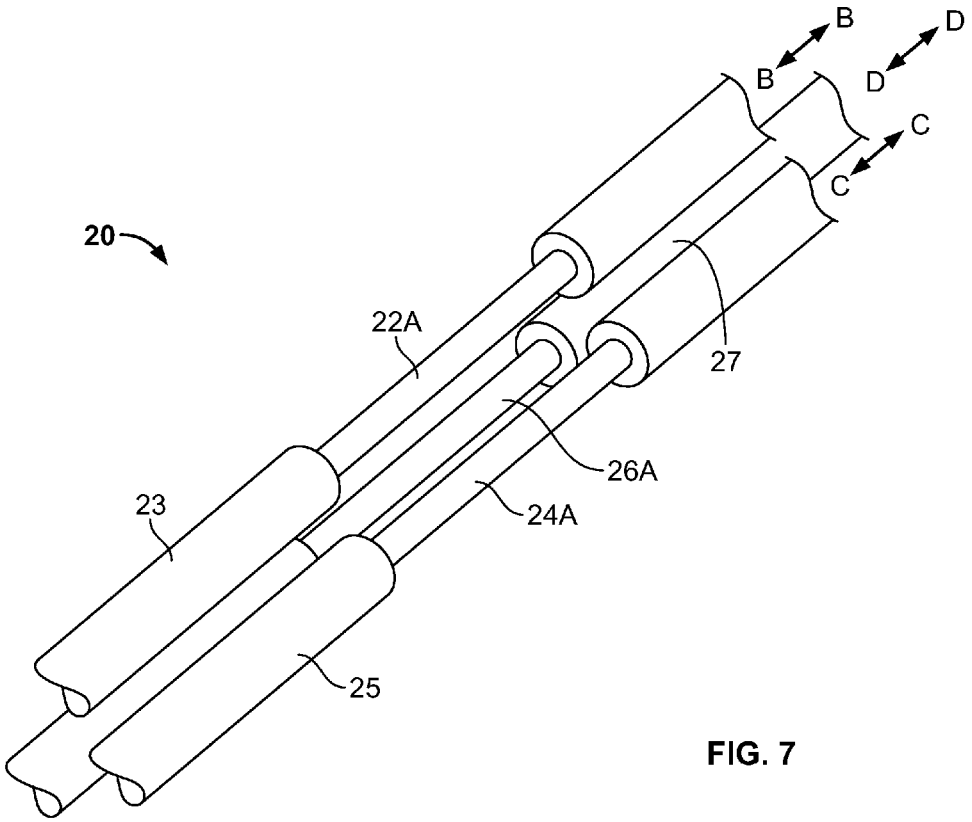
FIG. 7 is a fragmentary, perspective view of the run cable of FIG. 6 prepared for installation to form the electrical connection assembly of FIG. 1.

In use, a section of each insulation layer 23, 25 and 27 is stripped from the conductors 22, 24 and 26 to provide a corresponding exposed conductor section 22A, 24A and 26A, respectively, as shown in FIG. 7. In some embodiments and as shown, the conductors 22, 24, 26 are not themselves broken, severed or cut through in this region, so that the conductors 22, 24, 26 and the insulation layers 23, 24, 25 each extend beyond the exposed conductor sections 22A, 24A, 26A in both axial directions.

Similarly, in use, a section of the insulation 44 is stripped from the tap conductor 42 to provide an exposed conductor section 42A as shown in FIG. 8. In some embodiments, the conductor 42 is not broken, severed or cut through, so that the conductor 42 and the insulation 44 extend beyond the section 42A in both axial directions.

The connector 100 includes a lower connector body 110, an upper connector body 130, and four shearbolts 150. When installed and assembled as shown in FIGS. 1-4, the connector 100 defines an axial through passage 102 having axially opposed end openings 104 and defining a connector axis A-A.

The bodies 110, 130 may be formed of any suitable electrically conductive material. According to some embodiments, the bodies 110, 130 are formed of a metal such as aluminum or copper alloy. The shearbolts 150 may be formed of any suitable material, and in some embodiments, are formed of a metal such as copper. According to some embodiments, the bodies 110 and 130 are each monolithic.

The body 110 includes opposed axially extending coupling grooves 112, and opposed axially extending coupling flanges or rails 114. The body. 110 defines an axially extending conductor channel 116 including a run conductor seat subchannel 118.

The body 130 includes opposed, axially extending coupling channels 132 and opposed axially extending coupling flanges or rails 134. The body 130 has an axially extending conductor channel 136 including a pair of run conductor seat subchannels 138. Radially extending shearbolt bores 139 are defined in the body 130 and intersect the subchannels 138.

The shearbolts 150 can be of any suitable type or design operative to shear off at a desired prescribed or pre-set torque. The exemplary shearbolts 150 each include a shaft 152, a head 154, and an engagement face 156 opposite the head 154.

According to methods of the invention, the connection assembly 10 may be formed as follows.

The cables 20, 40 are prepared as discussed above to form the exposed conductor sections 22A, 24A, 26A and 42A.

The tap conductor exposed section 42A is inserted between the three run conductor exposed sections 22A, 24A, 26A.

The lower connector body 110 is placed under the conductor 26 such that the conductor 26 is received in the subchannel 118 with the conductor axis D-D substantially parallel to the connector axis A-A. The upper connector body 130 is placed over the conductors 22, 24 (at a location axially spaced from the lower connector body 110) such that the conductors 22 and 24 are received in the subchannels 138 with the conductor axes B-B, C-C substantially parallel to the connector axis A-A. The bodies 110 and 130 are then slid axially together to a position surrounding the exposed conductor sections 22A, 24A, 26A, 42A. The bodies 110, 130 are slid together so that the rails 114 interlock with the grooves 132 and the rails 134 interlock with the grooves 112. The conductor sections 22A, 24A, 26A, 42A extend substantially parallel with the connector axis A-A and out of the axial through passage 102 through each of the end openings 104. Thus, the conductor sections 22A, 24A, 26A, 42A are laid or placed in the passage 102 in the side-by-side relation.

Figure 4:
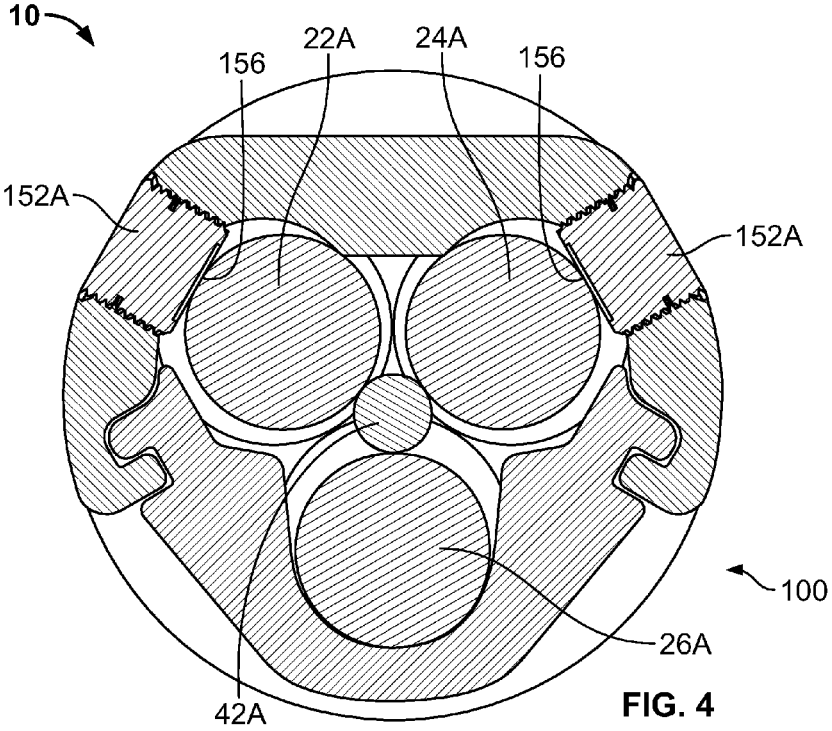
FIG. 4 is a cross-sectional, view of the electrical connection assembly of FIG. 1 taken along the line 3-3 of FIG. 1 following a step of clamping shearbolts of the electrical connection assembly.
Figure 5:
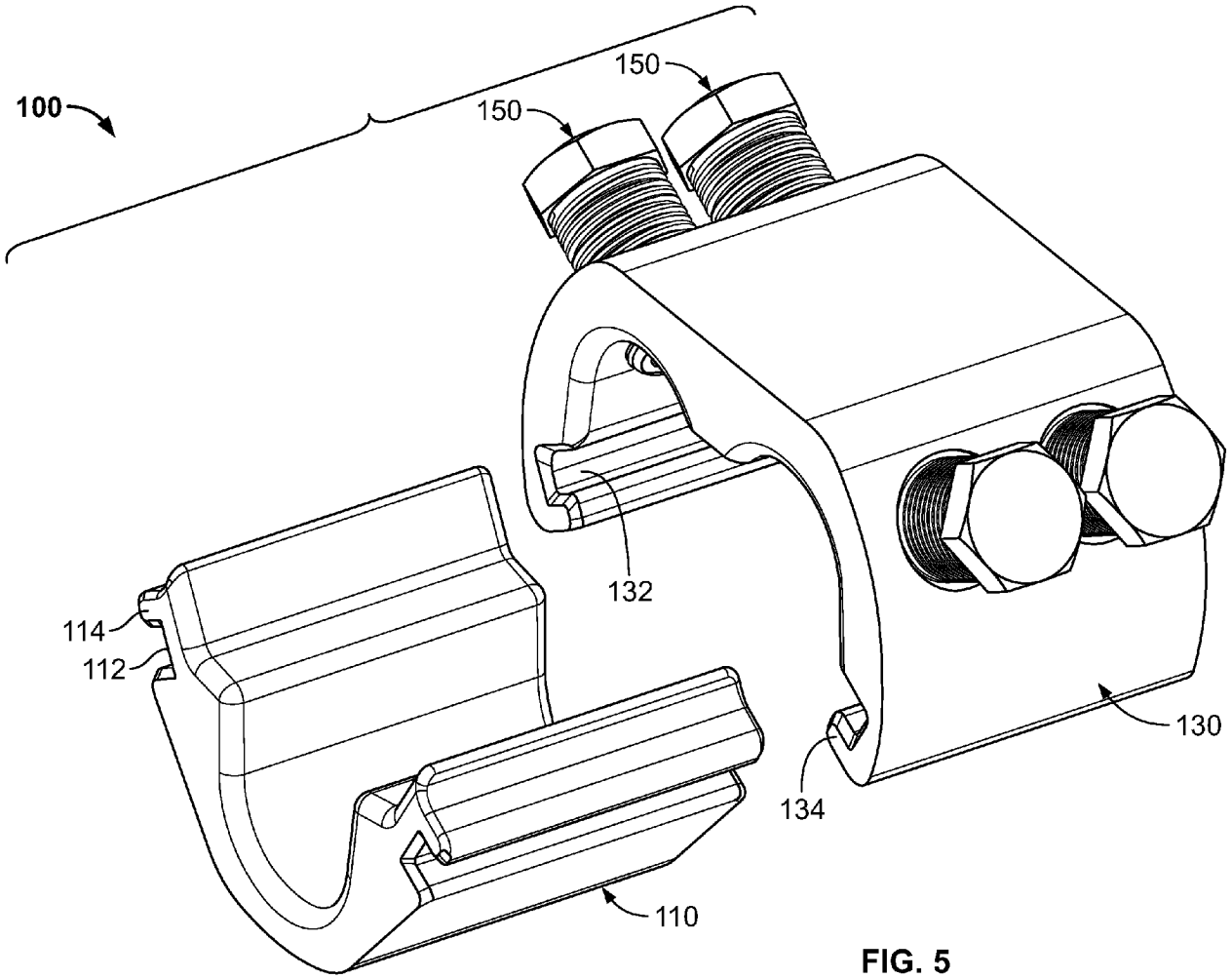
FIG. 5 is an exploded, perspective view of an electrical connector forming a part of the electrical connection assembly of FIG. 1 according to embodiments of the present invention.

The shearbolts 150 may be hand tightened to secure the conductors 22, 24, 26, 42 in place. The engagement faces 152A will abut and apply pressure to the conductor sections 22A, 24A and 26A. Each shearbolt 150 is then tightened using a driver (e.g., a bolt driver or socket wrench) applied to its head 152 until the appropriate torque is achieved, whereupon the head 152 breaks off, leaving behind a remainder portion 152A as shown in FIG. 4. According to some embodiments, each shearbolt 150 shears at a location substantially flush with or inset from the outer surface of the body 130. The shearbolts 150 thus serve as clamping mechanisms for both the conductor sections 22A, 24A, 26A and the conductor section 42A.

In the foregoing manner, the conductor sections 22A, 24A, 26A, 42A are laterally or radially compressed into direct intimate mechanical and electrical contact with one another, and the bodies 110 and 130 are placed in radial or circumferential tension. The connector 100 is clamped onto each of the conductor sections 22A, 24A, 26A, 42A and the relative axial positions of the components 22A, 24A, 26A, 42A, 110 and 130 are thereby securely fixed. By interconnecting the conductors through direct contact with one another on the connection knot, the connection 10 can create an equipotential point. Because the conductors 22, 24, 26, 42 are not broken, severed or cut, it is not necessary to add additional connections and an implicit increased resistance in the circuit.

Further components may be installed over the connection 10 to electrically insulate and environmentally protect the connector 100 and the exposed conductor sections.

Figure 9:
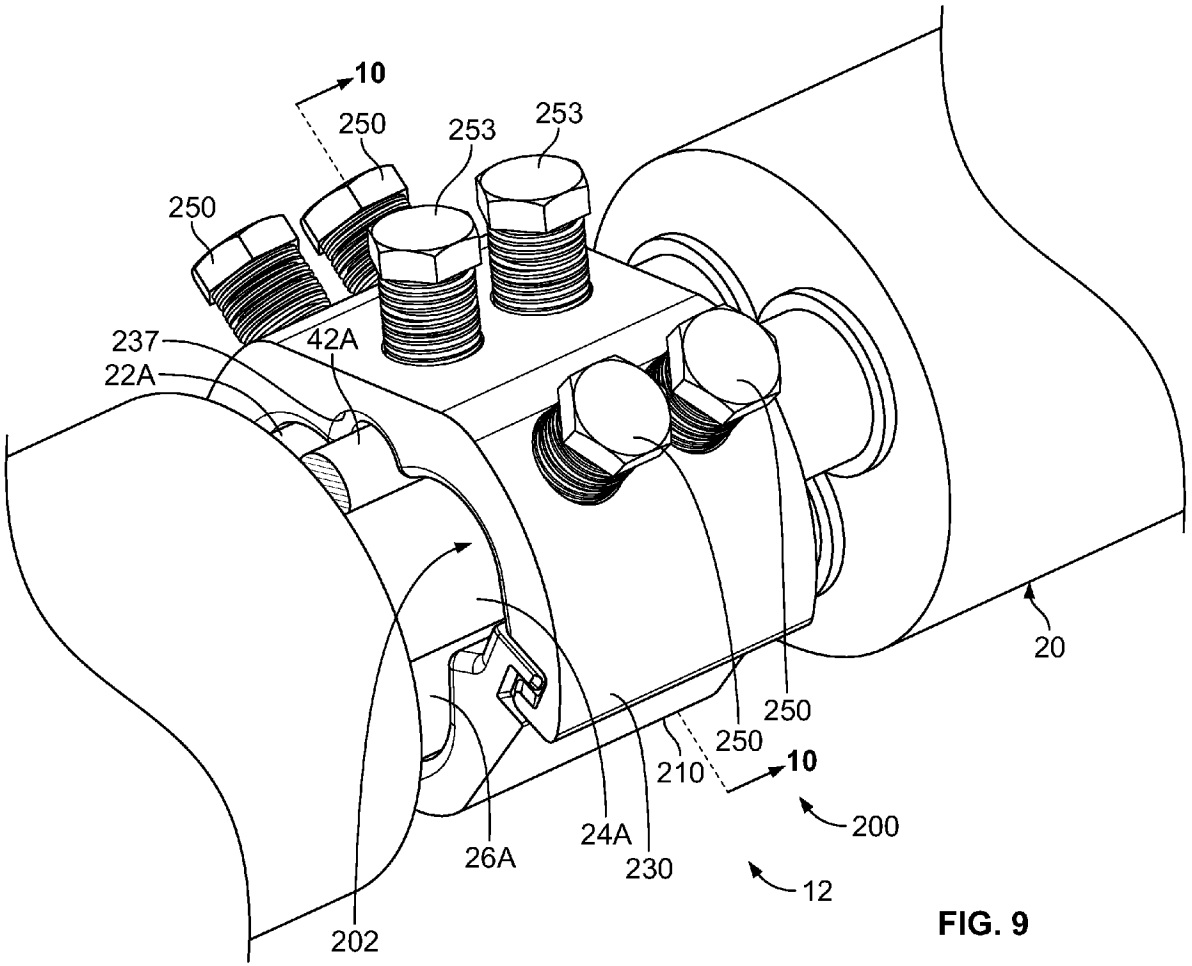
FIG. 9 is a fragmentary, perspective view of an electrical connection assembly according to further embodiments of the present invention.
Figure 10:
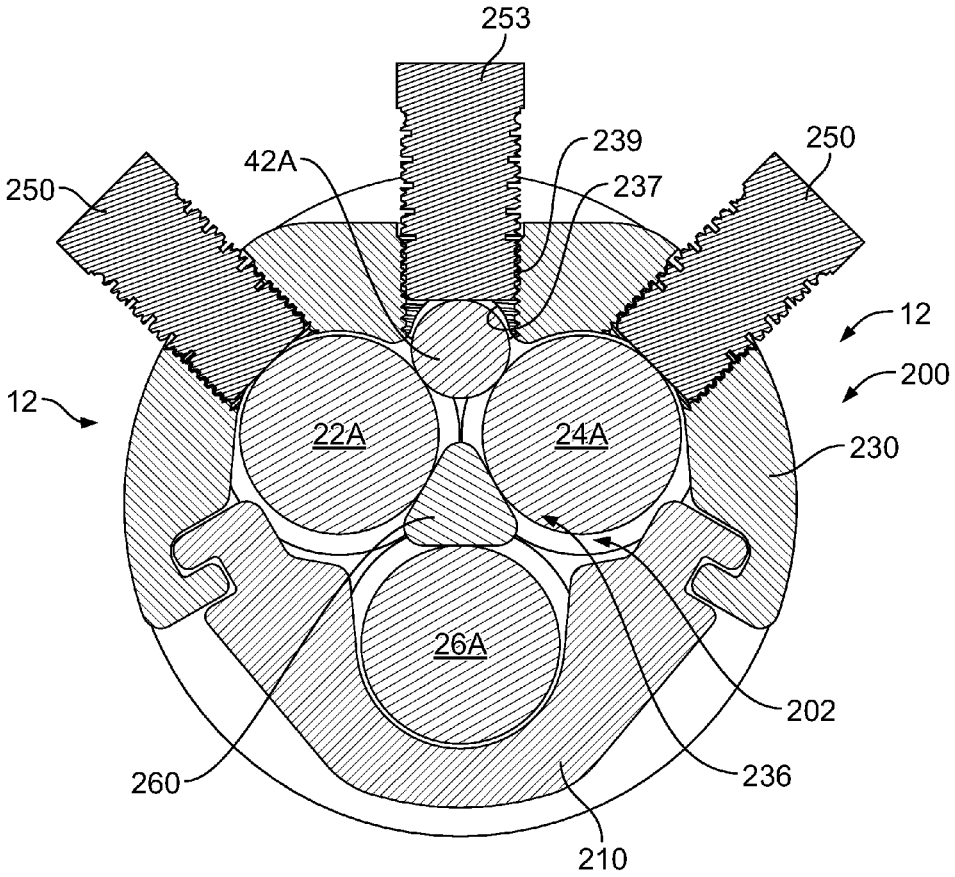
FIG. 10 is a cross-sectional view of the electrical connection assembly of FIG. 9 taken along the line 10-10 of FIG. 9.
Figure 11:
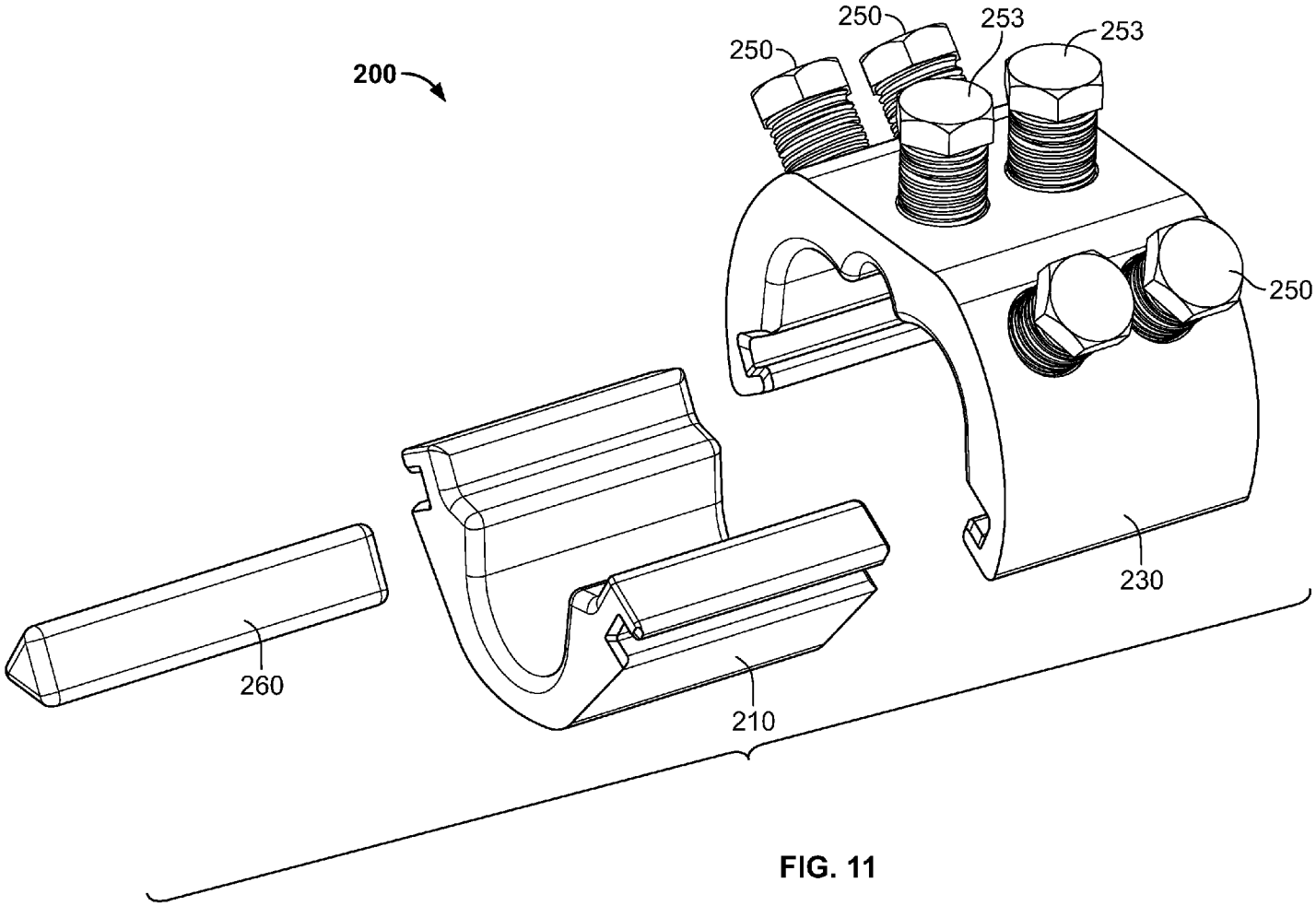
FIG. 11 is an exploded, perspective view of an electrical connector forming a part of the electrical connection assembly of FIG. 9 according to embodiments of the present invention.

With reference to FIGS. 9-11, a connection assembly 12 including a connector 200 (FIG. 11) according to further embodiments is shown therein. The connector 200 includes a lower connector body 210 (corresponding to connector body 110), an upper connector body 230, and shearbolts 250 corresponding to the shearbolts 150. The connection 12 and the conductor 200 differ from the connection 10 and the connector 100 in that the connector 200 includes a tap conductor seat subchannel 237 in the conductor channel 236 of the upper body 230, a spacer 260, a further pair of shearbolts 253 and a pair of associated bores 239 intersecting the seat channel 237. According to some embodiments, the spacer 260 is formed of a rigid, electrically conductive metal. In some embodiments, the spacer 260 is substantially triangular in cross-section.

The connector 200 can be used in the same manner as the connector 100 except that the tap conductor exposed section 42A is seated in the subchannel 237 and pressed by the shear bolts 253. The loading from the shearbolts 250 and 253 is applied to the spacer 260 through the conductor sections 22A, 24A and in turn by the spacer 260 to the conductor section 26A. The conductor sections 22A, 24A, 26A, 42A extend unbroken through the axial through passage 202 collectively formed by the connector bodies 210, 230.

Figure 12:
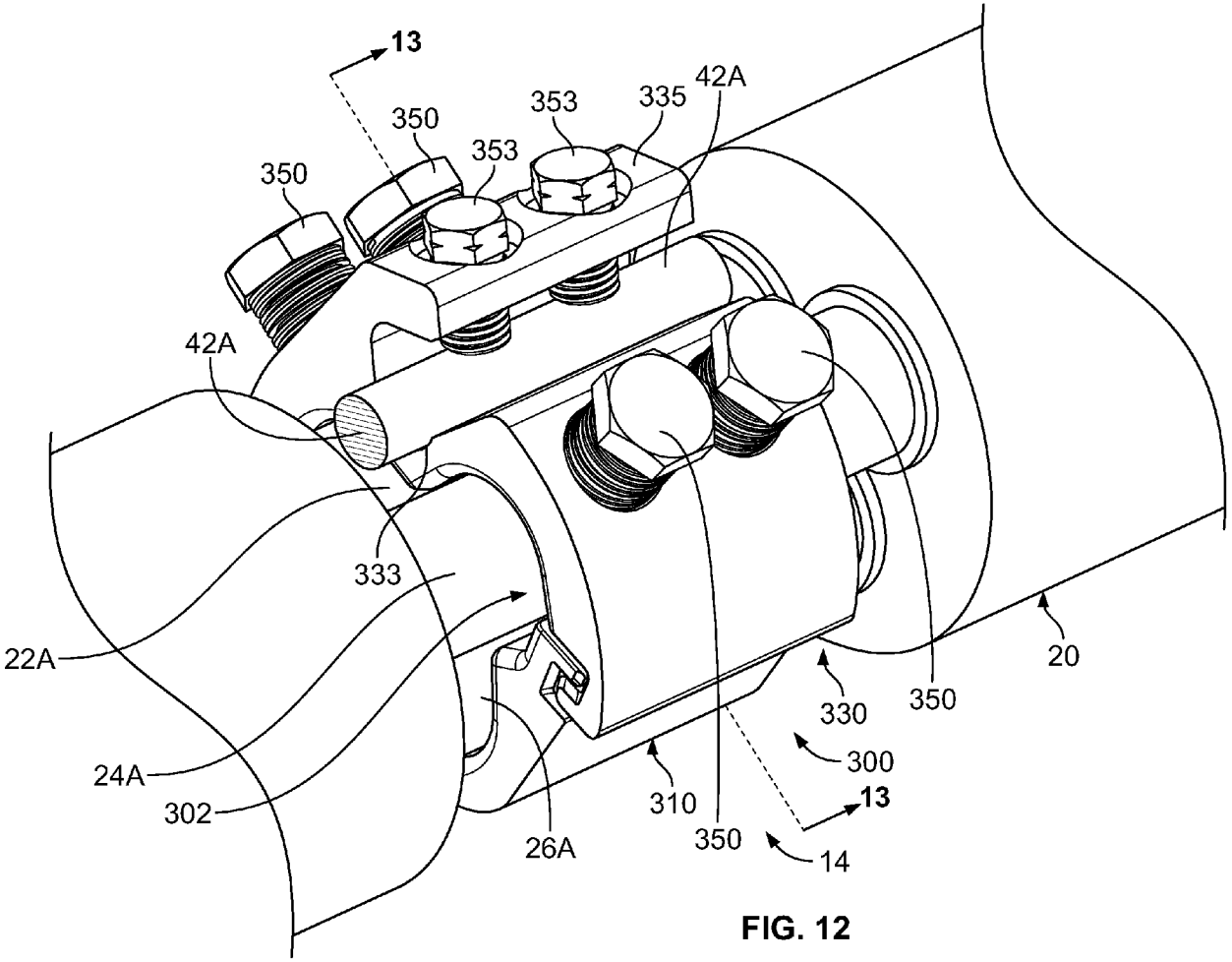
FIG. 12 is a fragmentary, perspective view of an electrical connection assembly according to further embodiments of the present invention.
Figure 13:
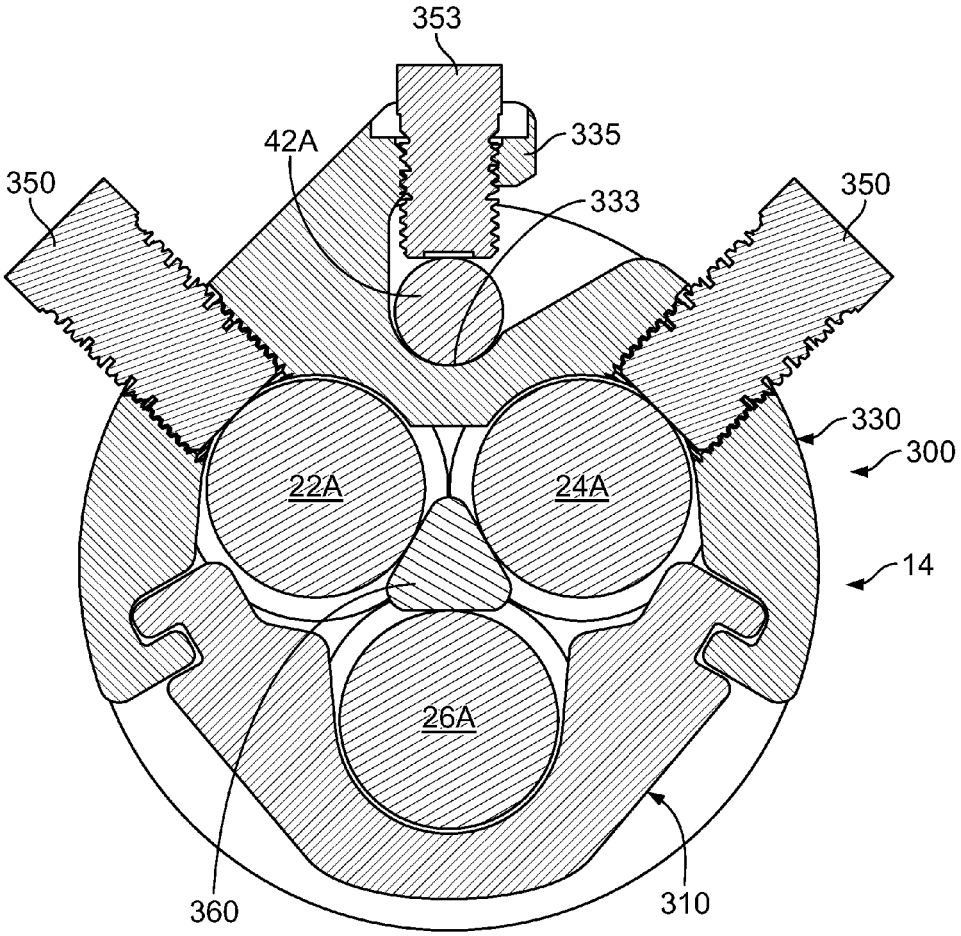
FIG. 13 is a cross-sectional view of the electrical connection assembly of FIG. 12 taken along the line 13-13 of FIG. 12.
Figure 14:
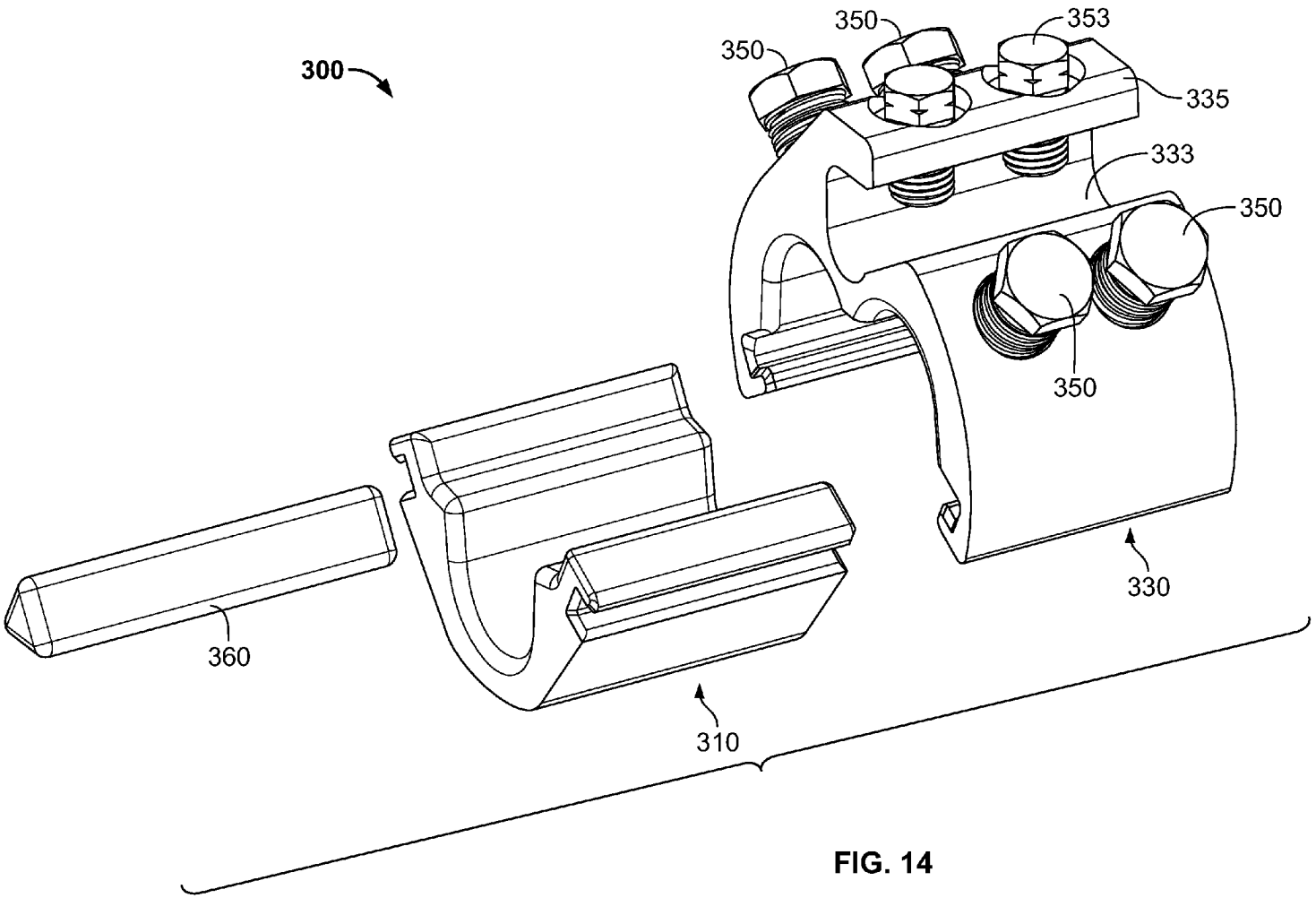
FIG. 14 is an exploded, perspective view of an electrical connector forming a part of the electrical connection assembly of FIG. 12 according to embodiments of the present invention.
Figure 15:
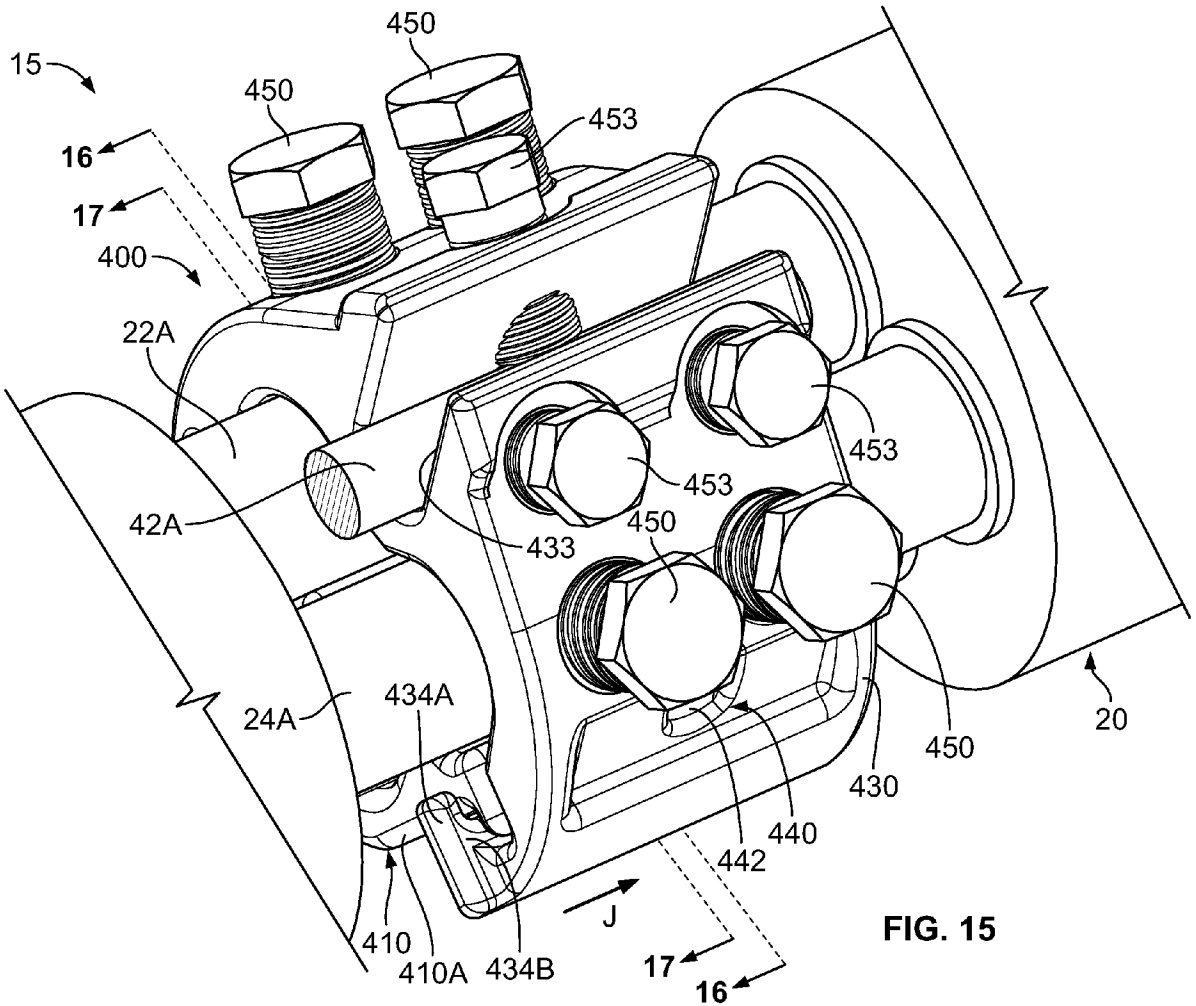
FIG. 15 is a fragmentary, perspective view of an electrical connection assembly according to further embodiments of the present invention.
Figure 16:
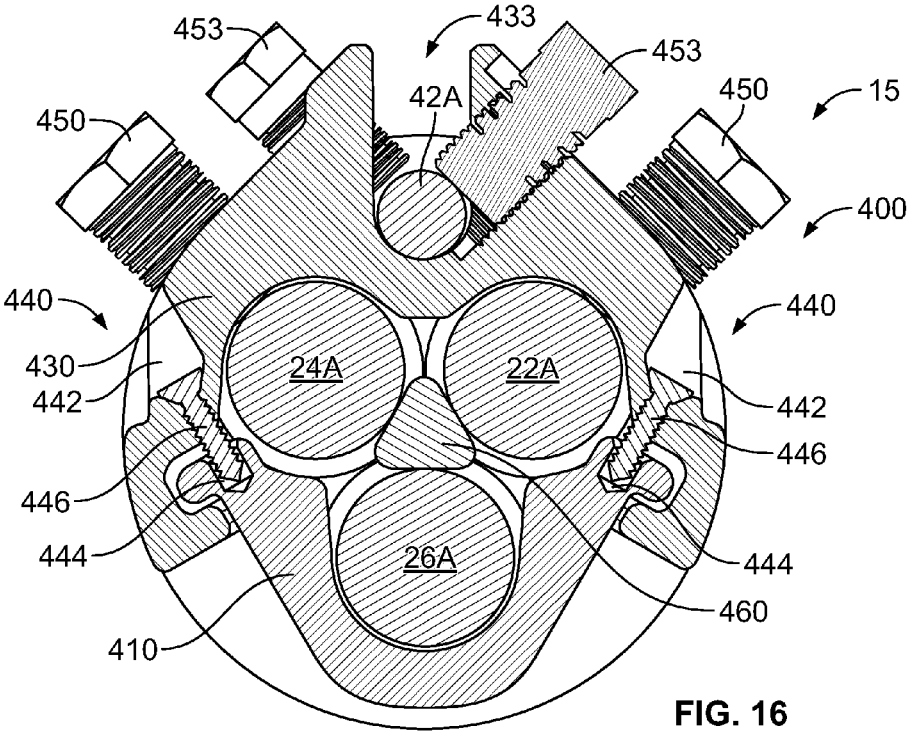
FIG. 16 is a cross-sectional view of the electrical connection assembly of FIG. 12 taken along the line 16-16 of FIG. 15.
Figure 17:
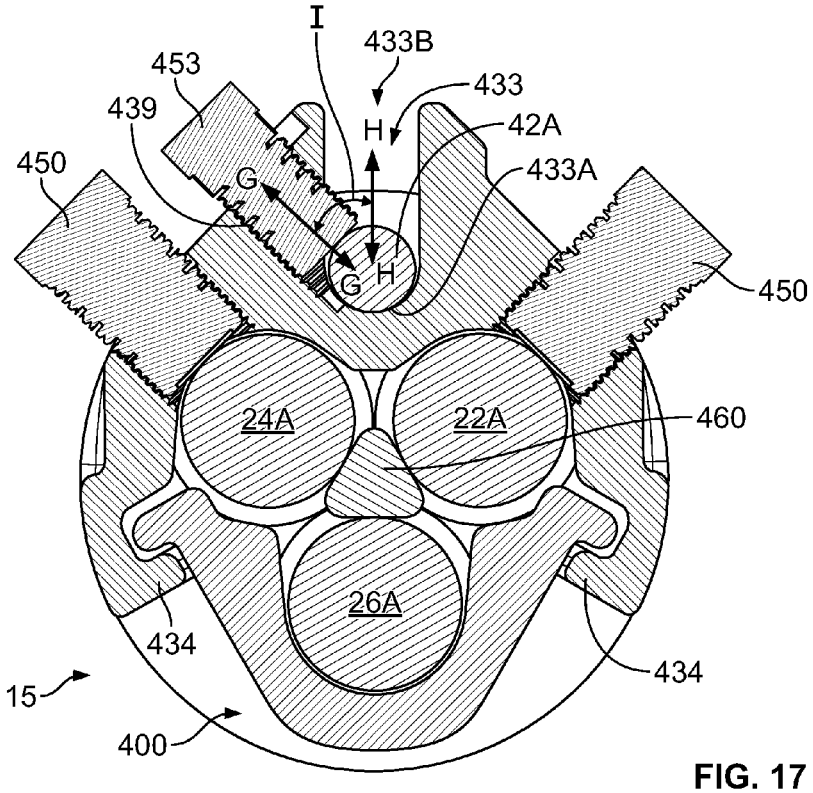
FIG. 17 is a cross-sectional view of the electrical connection assembly of FIG. 12 taken along the line 17-17 of FIG. 15.
Figure 18:
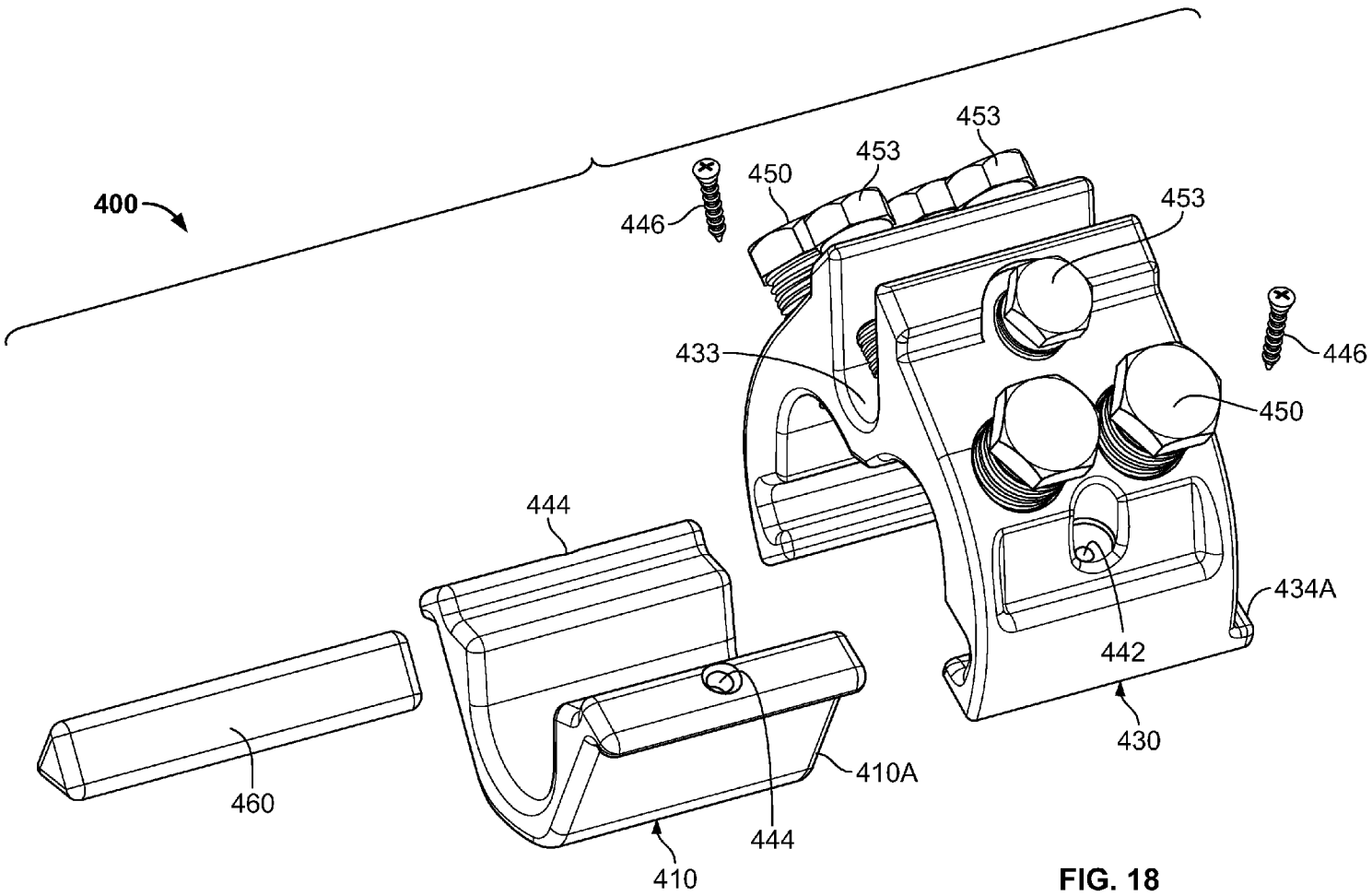
FIG. 18 is an exploded, perspective view of an electrical connector forming a part of the electrical connection assembly of FIG. 15 according to embodiments of the present invention.

With reference to FIGS. 12-14, a connection assembly 14 including a connector 300 (FIG. 14) according to further embodiments of the invention is shown therein. The connector 300 includes a lower connector body 330 generally corresponding to the connector body 130 (except as discussed below), and an electrically conductive spacer 360 corresponding to the spacer 260. The connection 14 and the connector 300 differ from the connection 10 and the connector 100 in that the connector body 330 includes an integral exterior tap conductor seat channel 333 (extending axially parallel with the connector through passage 302), an integral axial flange 335 (extending parallel and radially overlying the channel 333), and a further pair of shearbolts 353 and associated threaded bores 339 in the flange 335 to secure the tap conductor exposed section 42A in the seat channel 333.

In use, the connector bodies 330 and 310 are mounted around and clamped onto the conductor sections 22A, 24A, 26A in the same manner as described for the connector 100. The exposed tap conductor section 42A is then laterally inserted or laid in the channel 333 as shown in FIG. 12, and then secured in the channel 333 using the shearbolts 353, which serve as a clamping mechanism for the tap conductor section 42A.

With reference to FIGS. 15-18, a connection assembly 15 including a connector 400 (FIG. 18) according to further embodiments of the present invention is shown therein. The connector 400 includes a lower connector body 410 generally corresponding to the connector body 310, an upper connector body 430 generally corresponding to the connector body 330, and an electrically conductive spacer 460 corresponding to the spacer 260. The connector 400 and the connection assembly 15 may correspond to the connector 300 and the connection assembly 14 except as follows.

The upper connector body 430 includes a straight, U-shaped exterior tap conductor seat channel 433 (extending axially parallel with the connector axial through passage 402), shearbolts 453 and associated threaded bores 439 to secure the tap conductor exposed section 42A in the seat channel 433. The seat channel 433 has an axially extending bottom wall 433A and an opposing, axially extending, elongate channel opening 433B. The threaded bores 439 are oriented so that the insertion or clamping load axis G-G of the shearbolts 453 forms an oblique angle I with the heightwise axis H-H of the channel 433. As a result, the shearbolts 453 tend to force the tap conductor section 42A toward the bottom wall 433A from opposite sides. When the shearbolts 453 are retracted, the installer can lay the section 42A directly radially (i.e., in a direction along the axis H-H) into the channel 433 through the opening 433B.

The connector 400 further includes laterally opposed stop features or prongs 434A projecting radially inwardly from the ends 434B of the rails 434. When the upper connector body 430 is slid (in a direction J) onto the lower connector body 410 as described above, the stop prongs 434A engage the end 410A of the lower connector body 410 to limit the relative axial displacement between the bodies 410, 430, thereby ensuring proper registration, alignment or positioning of the bodies 410, 430.

The connector 400 further includes a pair of laterally opposed locking mechanisms 440 that may be used to lock or secure the relative axial positioning of the bodies 410 and 430. Each locking mechanism 440 includes a bore 442 (e.g., a tapped or threaded bore) in the upper body 430, a bore 444 (e.g., a clearance bore) in the lower body 410, and a set or lock screw 446. In order to secure the connector bodies 410, 430, the lock screw 446 is screwed through the associated bore 442 and into the associated bore 444 to interlock the bodies 410, 430 together and thereby prevent further axial sliding between the bodies 410, 430. According to some embodiments, the bodies 410, 430 are interlocked together in this manner prior to clamping the shearbolts 450 onto the conductor sections 22A, 24A, 26A so that the bodies 410, 430 are held firmly aligned during the cable clamping steps.

Figure 19:
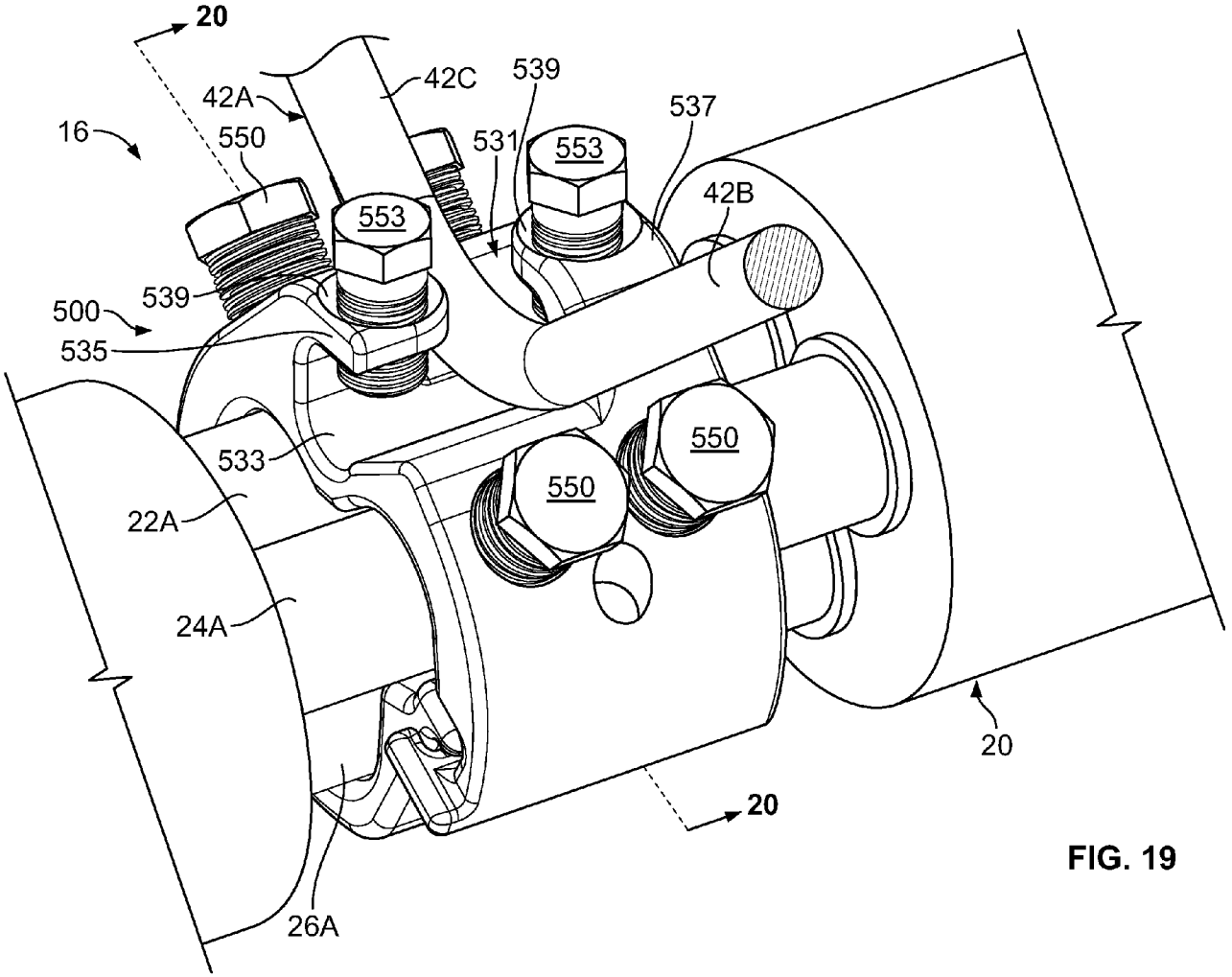
FIG. 19 is a fragmentary, perspective view of an electrical connection assembly according to further embodiments of the present invention.
Figure 20:
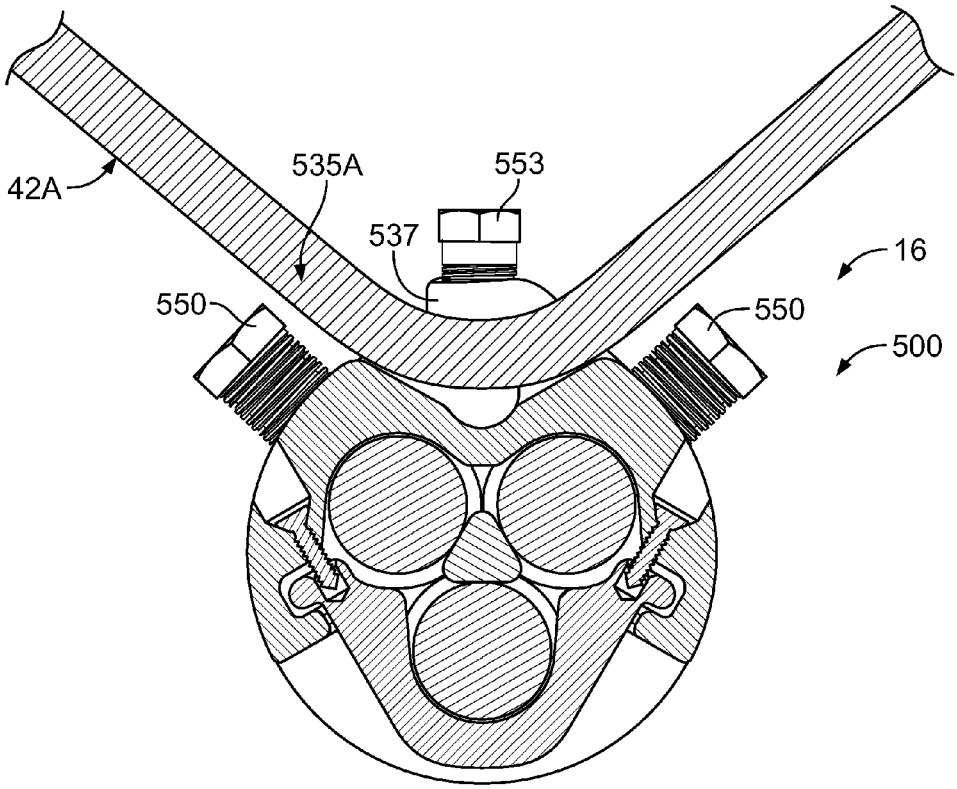
FIG. 20 is a cross-sectional view of the electrical connection assembly of FIG. 12 taken along the line 20-20 of FIG. 19.
Figure 21:
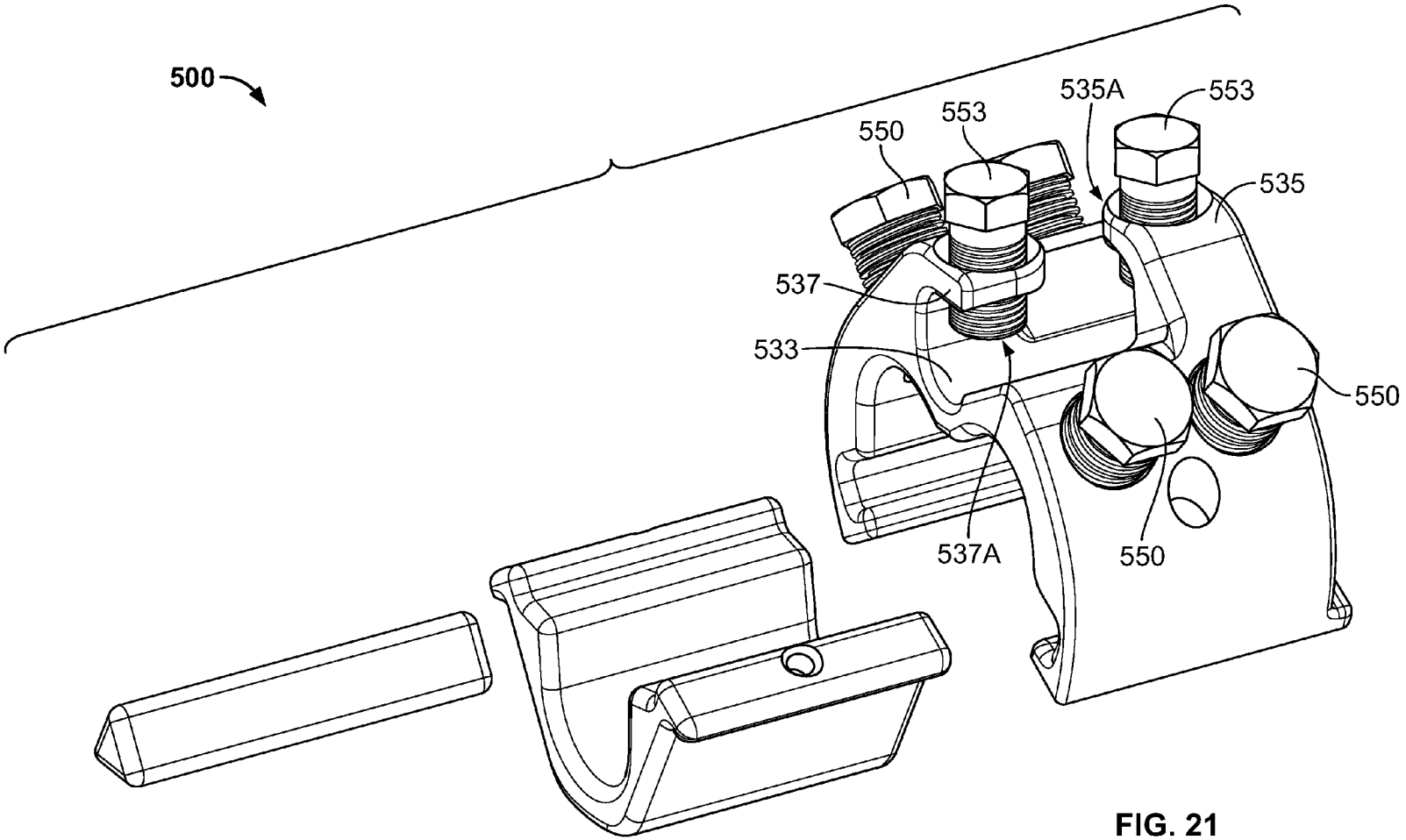
FIG. 21 is an exploded, perspective view of an electrical connector forming a part of the electrical connection assembly of FIG. 19 according to embodiments of the present invention.

With reference to FIGS. 19-21, a connection assembly 16 and a connector 500 (FIG. 21) according to further embodiments of the invention are shown therein. The connection assembly 16 and the connector 500 correspond generally to the connection assembly 15 and the connector 400 except with regard to the mechanism for securing the tap conductor section 42A. The connector 500 includes an axially extending exterior tap conductor seat channel 533. A pair of axially spaced apart ears or tabs 535 and 537 overhang the channel 533. The tabs 535 and 537 define a radially opening slot 531 therebetween and also define respective laterally opening slots 535A and 537A that face in opposite lateral directions. Each tab 535, 537 has a threaded bore 539 and a shearbolt 553 mounted therein.

In use, the conductor sections 22A, 24A, 26A are clamped between the connector bodies 510 and 530 using the shearbolts 550 as described above with regard to the connector 100. The tap conductor 42 may then be inserted to extend laterally through the slot 531, then rotated and pulled to lay a section 42B in the channel 533 through the slot 535A, and then swiveled to lay a section 42C in the channel 533 through the slot 537A. The sections 42B, 42C are then secured in place by the shearbolts 553.

Figure 22:
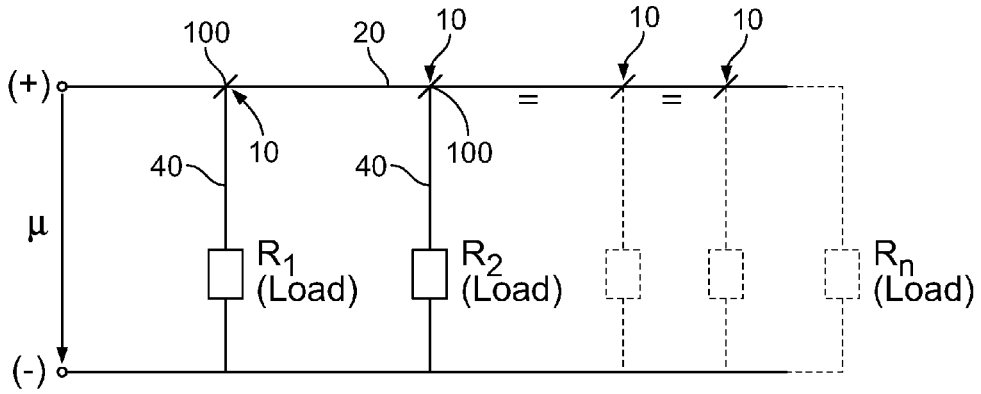
FIG. 22 is a schematic electrical diagram of an electrical circuit including the electrical connector assembly of FIG. 1.

According to some embodiments, the connectors as disclosed herein (e.g., connectors 100, 200, 300, 400, and 500) are used for connecting underground power cables, such as cables in underground systems in densely populated areas. In some embodiments, the connectors are used in a DC power system or circuit. In some embodiments, the tap cables 40 (via the conductors 42) feed power pushed through the run conductors 22, 24, 26 of the run cable 20 to secondary loads or circuits situated along the path of the run cable 20. A schematic diagram of an exemplary circuit as shown in FIG. 22.

According to some embodiments, the primary conductors 22, 24, 26 are larger in diameter than the secondary conductor 42. In some embodiments, the primary conductors 22, 24, 26 are 1000 kcmil conductors and the secondary conductor 42 is a 250 kcmil conductor. According to some embodiments, the conductors 22, 24, 26, 42 are compact conductors.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

That which is claimed is:

1. An electrical connection assembly comprising:

a plurality of primary electrical conductors;

a secondary electrical conductor; and an electrical connector including:

a first connector body including an exterior conductor seat channel;

a second connector body coupled to the first connector body such that the first and second connector bodies collectively form an axial through passage;

a primary clamping mechanism on at least one of the first and second connector bodies; and a secondary clamping mechanism on the first connector body;

wherein:

the secondary electrical conductor extends through the exterior conductor seat channel and is clamped therein by the secondary clamping mechanism;

the primary electrical conductors extend through the axial through passage and are clamped therein by the primary clamping mechanism to the first and second connector bodies and to one another to mechanically and electrically connect the primary and secondary electrical conductors; and the assembly further includes a plurality of primary cables and a secondary cable, wherein:

each of the primary cables includes a respective one of the primary electrical conductors and a primary insulation layer surrounding the electrical conductor, a section of the primary insulation layer being removed to present an exposed primary conductor section and the primary insulation layer extending axially away from the exposed primary electrical conductor section on both axial sides thereof;

the secondary cable includes the secondary electrical conductor and a secondary insulation layer surrounding the secondary electrical conductor, a section of the secondary insulation layer being removed to present an exposed secondary conductor section and the secondary insulation layer extending axially away from the exposed secondary conductor section on both axial sides thereof;

the exposed primary conductor section of each primary cable is disposed in the axial through passage; and the exposed secondary conductor section is disposed in the exterior conductor seat channel.

2. The electrical connection assembly of claim 1 wherein the exterior conductor seat channel and the secondary electrical conductor extending therethrough extend substantially axially parallel to the axial through passage and the primary electrical conductors extending therethrough.

3. The electrical connection assembly of claim 1 wherein the primary electrical conductors extend fully through the axial through passage unbroken.

4. The electrical connection assembly of claim 3 wherein at least some of the primary electrical conductors are in direct contact with one another in the axial through passage.

5. The electrical connection assembly of claim 3 wherein the plurality of primary electrical conductors include three primary electrical conductors extending fully through the axial through passage unbroken.

6. The electrical connection assembly of claim 1 including a jacket surrounding all of the primary cables.

7. The electrical connection assembly of claim 1 wherein the primary and secondary clamping mechanisms include threaded bolts.

8. The electrical connection assembly of claim 7 wherein the primary and secondary clamping mechanisms include shearbolts.

9. The electrical connection assembly of claim 1 wherein the first and second connector bodies are axially slidably coupled by integral rails and grooves.

10. The electrical connection assembly of claim 9 including a set screw locking the relative axial positions of the first and second connector bodies.

11. The electrical connection assembly of claim 9 wherein at least one of the first and second connector bodies includes a stop feature to limit relative axial displacement between the first and second connector bodies.

12. The electrical connection assembly of claim 1 wherein the primary electrical conductors are each seated in a respective one of a plurality of conductor channels defined in the first and second connector bodies.

13. The electrical connection assembly of claim 1 including an electrically conductive spacer disposed in the through passage between the primary electrical conductors, wherein the primary electrical conductors are clamped onto the spacer by the primary clamping mechanism.

14. The electrical connection assembly of claim 1 wherein:

the exterior conductor seat channel is open to receive the secondary electrical conductor along an insertion axis; and the secondary clamping mechanism includes a bolt that applies a clamping load along a clamping axis that is oblique to the insertion axis.

15. The electrical connection assembly of claim 1 wherein:

the first connector body includes a pair of integral, axially spaced apart tabs overlying the exterior conductor seat channel; and the secondary clamping mechanism includes a pair of bolts each mounted in a respective one of the tabs to clamp the secondary electrical conductor into the exterior conductor seat channel.

16. The electrical connection assembly of claim 1 wherein:

the first connector body includes an integral, axially extending flange overlying the exterior conductor seat channel; and the secondary clamping mechanism includes a plurality of bolts mounted in the flange to clamp the secondary electrical conductor into the exterior conductor seat channel.

17. An electrical connection assembly comprising:

a plurality of primary electrical conductors;

a secondary electrical conductor; and an electrical connector including:

a first connector body including an exterior conductor seat channel;

a second connector body coupled to the first connector body such that the first and second connector bodies collectively form an axial through passage;

a primary clamping mechanism on at least one of the first and second connector bodies; and a secondary clamping mechanism on the first connector body;

wherein:

the secondary electrical conductor extends through the exterior conductor seat channel and is clamped therein by the secondary clamping mechanism;

the primary electrical conductors extend through the axial through passage and are clamped therein by the primary clamping mechanism to the first and second connector bodies and to one another to mechanically and electrically connect the primary and secondary electrical conductors; and the first and second connector bodies are axially slidably coupled by integral rails and grooves.

18. The electrical connection assembly of claim 17 including a set screw locking the relative axial positions of the first and second connector bodies.

19. The electrical connection assembly of claim 17 wherein at least one of the first and second connector bodies includes a stop feature to limit relative axial displacement between the first and second connector bodies.

20. An electrical connection assembly comprising:

a plurality of primary electrical conductors;

a secondary electrical conductor; and an electrical connector including:

a first connector body including an exterior conductor seat channel;

a second connector body coupled to the first connector body such that the first and second connector bodies collectively form an axial through passage;

a primary clamping mechanism on at least one of the first and second connector bodies; and a secondary clamping mechanism on the first connector body;

wherein:

the secondary electrical conductor extends through the exterior conductor seat channel and is clamped therein by the secondary clamping mechanism; and the primary electrical conductors extend through the axial through passage and are clamped therein by the primary clamping mechanism to the first and second connector bodies and to one another to mechanically and electrically connect the primary and secondary electrical conductors; and the primary electrical conductors are each seated in a respective one of a plurality of conductor channels defined in the first and second connector bodies.

21. An electrical connection assembly comprising:

a plurality of primary electrical conductors;

a secondary electrical conductor; and an electrical connector including:

a first connector body including an exterior conductor seat channel;

a second connector body coupled to the first connector body such that the first and second connector bodies collectively form an axial through passage;

a primary clamping mechanism on at least one of the first and second connector bodies; and a secondary clamping mechanism on the first connector body;

wherein:

the secondary electrical conductor extends through the exterior conductor seat channel and is clamped therein by the secondary clamping mechanism;

the primary electrical conductors extend through the axial through passage and are clamped therein by the primary clamping mechanism to the first and second connector bodies and to one another to mechanically and electrically connect the primary and secondary electrical conductors; and the electrical connection assembly further includes an electrically conductive spacer disposed in the through passage between the primary electrical conductors, wherein the primary conductors are clamped onto the spacer by the primary clamping mechanism.

* * * * *